US006183327B1

(12) United States Patent
Meyer

(10) Patent No.: US 6,183,327 B1
(45) Date of Patent: Feb. 6, 2001

(54) SWIM FIN STRUCTURE

(76) Inventor: Douglas Meyer, 1 Jodrell Street, Innisfail, Queensland 4860 (AU)

( * ) Notice: Under 35 U.S.C. 154(b), the term of this patent shall be extended for 0 days.

(21) Appl. No.: 09/473,823

(22) Filed: Dec. 28, 1999

(51) Int. Cl.[7] ..... A63B 31/08
(52) U.S. Cl. ..... 441/64
(58) Field of Search ..... 441/61–64

(56) References Cited

U.S. PATENT DOCUMENTS 4,541,810 * 9/1985 Wenzel ..... 441/64
4,934,971 * 6/1990 Picken ..... 441/64
5,906,525 * 5/1999 Melius et al. ..... 441/64

* cited by examiner

*Primary Examiner*—Jesus D. Sotelo
(74) *Attorney, Agent, or Firm*—Malloy & Malloy, P.A.

(57) ABSTRACT

A swim fin structured to be removably mounted on the foot of a swimmer, wherein the swim fin is intended to be used in pairs in the conventional fashion. A foot attachment portion, is secured to a fin portion, which includes a substantially elongated, at least partially triangular configuration including a periphery defined by a leading edge and a trailing edge. The fin portion also comprises two correspondingly dimensioned and configured flukes, each of which are disposed and structured to define a different one-half of the fin portion and which include two leading edge segments, collectively defining the leading edge of the fin portion and each being substantially transversely oriented to extend laterally outward from opposite sides of the attachment portion. Each of the flukes include a trailing segment extending contiguously along the length of the trailing edge of the fin portion and being formed from a material having sufficient flexibility to assume a variable configuration, as the swim fin travels through the water, wherein the variable configuration corresponds to and is in substantial conformance with a flow of water passing along the two opposite, exposed surfaces on the fin portion and facilitates driving engagement of the fin portion therewith.

25 Claims, 2 Drawing Sheets

SWIM FIN STRUCTURE

BACKGROUND OF THE INVENTION

1. Field of the Invention

The present invention relates to a swim fin structure including a fin portion with a pair of flukes transversely oriented relative to a foot attachment portion, so as to extend laterally outward from a wearer's foot, and formed from a material having sufficient flexibility to assume a variable configuration in conformance with a flow of water passing over an exposed surface thereof, such that a pocket-like structure is formed in each fluke, automatically adjusting to the flow of water in a manner which allows the pocket of each fluke to at least partially surround the water flow and be disposed in propelling engagement therewith, thereby substantially enhancing the propulsion capabilities to be achieved by a wearer of the swim fin structure.

2. Description of the Related Art

The use of swim fins to aid in propelling a swimmer through water has been in existence for many years. Typically, such swim fins come in pairs, such that a different swim fin is removably attached to each foot of the swimmer. For example, in typical fashion, known swim fin structures generally include a foot retaining structure having a generally hollow interior designed to receive at least a portion of the swimmer's foot therein. Additionally, the fin or propelling portion of traditional fins usually include substantially elongated configurations extending coextensively outward from a front portion of the foot retaining structure, with the overall fin being generally formed from a partially flexible material so as to provide somewhat of a "yielding-type" of resistance to the flow of water as the swimmer passes therethrough.

When utilizing a traditional pair of swim fins, the swimmer normally demonstrates a scissor-type kick or a flutter-type kick, characterized by the legs of the swimmer moving in substantially opposite directions and alternatively passing through both an up stroke and a down stroke. While such a flutter type kick is at least partially effective to aid the swimmer in being propelled through water, it is generally recognized that this type of kick exerts significant stress on the lower leg and ankle portion of the swimmer. Such excessive stress often times results in fatigue of the swimmer, and a diminishing of his or her performance, thereby at least partially defeating the purpose of utilizing swim fins.

With the increased popularity of water sports in general, and SCUBA diving in particular, numerous attempts have been made to increase the efficiency of swim fin structures by altering their overall structure and configuration, and in certain instances, varying the material from which conventional swim fin structures are normally formed. By way of example, one known and commercially available fin structure is commonly known as the "Force Fin", which incorporates a generally trapezoidal configuration and which includes a shoe portion having a hollow interior specifically dimensioned to allow a predetermined movement and/or flexing of the foot to aid the swimmer in the performance of the conventional flutter-type stroke. In this known type of swim fin structure, the muscles of the swimmer's foot are allowed to move, and in doing so are intended to assist the muscles of the lower leg to accomplish an alternate "kick and flip" type of movement of the fin during the performance of the aforementioned flutter kick. In addition, another known and commercially available swim fin structure is commonly referred to as the "Biofin" which is characterized by the fin portion having two segments separated by a generally elongated slot formed therein. This type of fin structure is also intended to be used when the swimmer performs the conventional flutter kick, wherein the fin, as is common with the vast majority of known or conventional swim fin structures, is alternately forced through the up and down strokes of the kick, utilizing the muscles of the lower leg, ankle and foot of the swimmer. Accordingly, it is generally recognized that utilization of known swim fin structures, including, but not limited to, the type of structures specifically set forth above, frequently results in a large amount of stress being placed on the ankle and/or lower leg, thereby frequently resulting in fatigue of the associated muscles of the swimmer, when such known or conventional swim fin structures are used for even a limited amount of time.

It is generally recognized that the human body, especially when traveling through water, such as when swimming or diving, is not very streamlined and thereby produces considerable drag and a significant path of "disturbed" water as the swimmer moves along an intended path of travel. When utilizing conventional or known swim fins, such as of the type set forth above, the alternating "flutter" type of kicking motion does not serve to most efficiently propel the swimmer through water. This is at least partially attributable to the fact that only one of the up and down strokes of the swimmer's legs serves as a propelling or driving stroke, wherein the other of the up and down strokes effectively serves as a "re-loading" stroke. The "re-loading" stroke, normally being the upwardly directed stroke, provides a minimum amount of propelling force in the direction of intended travel of the swimmer.

Based on the above disadvantages and recognized inefficiencies, there is a need in this area for an improved swim fin, which is capable of providing somewhat of a "gliding" effect and which serves to streamline the disturbed water or "wake" trailing the swimmer, by substantially directing the water, in somewhat of a spinning configuration, laterally outward, and to some extent, rearwardly away from an approximate center of the swimmer's path. In addition, an improved swim fin should also be capable of allowing the swimmer to demonstrate a more efficient "dolphin-type" stroke, resulting in a significantly decreased stress being placed on the ankle or lower muscles of the leg, due to less leverage being exerted thereon. Also, an improved swim fin structure, of the type set forth in greater detail hereinafter, should be capable of producing a propelling or driving stroke with both the upwardly directed stroke segment as well as the downwardly directed stroke segment of the kick being performed. The resulting double propelling motion would significantly increase the efficiency of movement and reduce the expended effort of the swimmer, when using such an improved swim fin structure. Further, in order to overcome the above noted disadvantages associated with conventional swim fins, at least one portion of such an improved swim fin structure should be formed of a semi flexible material which has sufficient structural integrity to demonstrate a "whiplike" action and further wherein an associated portion of the improved swim fin structure should be formed of a material having sufficiently greater flexibility. Such significantly greater flexibility would allow a fin portion to be substantially self adjusting and thereby assume a freely changeable or variable configuration, which at least partially conforms to the flow of water passing along or over exposed surfaces of the fin portion in a manner which effectuates a propelling or driving engagement thereof with the flow of water.

SUMMARY OF THE INVENTION

The present invention relates to a swim fin, preferably structured for use in a pair, wherein each swim fin is removably attached to a different foot of the swimmer. Accordingly, while it is recognized that the swim fins of the present invention are intended to be used in pairs, as set forth above, the description of the structure and operation of the present invention will be described with reference to a single swim fin intended to be removably attached to one of the feet of the swimmer.

For reasons to be explained in greater detail hereinafter, the swim fins of the present invention, when attached to the feet of a swimmer, are preferably and most efficiently operable when the swimmer demonstrates what is commonly known as a "dolphin" kick, as opposed to the more conventional flutter or scissor kick often utilized with fin structures of known or conventional design, or alternatively, when the swimmer is not using any type of swim fin structure. Therefore, when the swimmer, using the swim fins of the present invention, demonstrates the aforementioned dolphin kick, the swimmer performs a "body wave" type of motion, which starts at the shoulders and continues aft as the legs are used in the aforementioned dolphin kick. The swimmer thereby relies predominantly on the muscles of the abdomen, back, hips, buttocks and thighs, significantly reducing the somewhat excessive stress normally placed on the lower legs and ankles when the swimmer performs the flutter or scissor kick, as set forth above.

In performing the dolphin kick, when a swimmer utilizes the swim fins of the present invention, the swimmer preferably positions one foot in spaced relation somewhat above or outwardly from the other, dependent on the direction of travel of the swimmer. Therefore, in performing the dolphin kick, the feet of the swimmer are separated normally by approximately six inches. However, this spaced distance between the fins may of course vary dependent on a number of factors. Initially, a deep or more exaggerated up and down motion is used to build momentum and speed followed by a somewhat shallow and quicker sculling motion. When demonstrating such motion and due to the structural features of the swim fin of the present invention, the flow of water is substantially pulled across the oppositely disposed working surfaces or foils of each of the swim fins as they travel through a motion or movement comparable to that of the tail of a dolphin.

More specifically, the structural features of the swim fin of the present invention include an attachment portion specifically structured to be secured, in at least partially surrounding relation, to a foot of the swimmer in a manner which facilitates secure, comfortable but removal mounting of the swim fin on one of the swimmer's feet. In addition, the swim fin of the present invention comprises a fin portion secured to what may be considered an outer most end of the attachment portion, such as by an integral or otherwise fixed connection. The fin portion comprises what may generally be considered an elongated, substantially triangular configuration, wherein the length or primary longitudinal dimension of the fin portion is oriented in transverse relation to the length of the attachment portion.

More specifically, the fin portion of the present invention preferably comprises and is collectively defined by two flukes. Each of the two flukes is preferably equivalently or correspondingly dimensioned and configured, so as to define a different half of the aforementioned, generally elongated triangular configuration. Further, the flukes are preferably integrally or otherwise fixedly secured to one another and may be formed from a one piece, substantially unitary construction. The flukes are preferably substantially symmetrically disposed relative to the attachment portion, such that an imaginary center line of the fin portion is defined by corresponding inner ends of each fluke being joined together, preferably by a seamless construction, generally along the imaginary center line.

The core segment of each fluke is preferably formed from a semi-flexible material demonstrating sufficient flexibility to provide what may be referred to as a "whiplike" action during the up and down strokes of the swimmer. A cooperatively disposed and integrally connected trailing segment of each fluke is formed from a material having significantly greater flexibility than the core segment thereof. More specifically, the trailing segment of each fluke is preferably formed from a material having sufficient flexibility to assume a variable configuration, which may freely or "automatically" change corresponding to and in substantial conformance with a flow of water passing along an exposed surface of each fluke of the fin portion. The aforementioned "variable" configuration, is at least partially defined by the ability of each fluke to "self adjust" the shape or orientation thereof in a manner which allows the formation of a pocket in each of the flukes. Each of the pockets so formed functions to minimally or partially surround the aforementioned flow of water or at least partially conform thereto and thereby exert a propelling or driving force thereon. That in turn serves to facilitate the forward motion of the swimmer while performing the aforementioned dolphin kick. Each of the aforementioned pockets is temporarily formed in each of the flukes, to the extent that the pocket assumes a somewhat concave or arcuate configuration and remains so formed in each of the flukes during at least a portion each of the downward and upward kicks of the stroke. Obviously, when the swim fin changes direction during the dolphin kick, such as when converting from a downwardly directed stroke to an upwardly directed stroke, the aforementioned pocket disappears from one exposed surface of each fluke and is reformed in an opposite, exposed surface of each fluke. Therefore the pockets formed in each fluke at least partially or minimally surround and drivingly engage the flow of water passing over each of the two oppositely disposed, exposed surfaces of the fin portion of each swim fin, during successive strokes of each dolphin kick.

Another feature of at least one embodiment of the present invention includes a hydrodynamic foil of the fin portion defined by the oppositely disposed surfaces of the fin portion, which may assume a somewhat elongated "teardrop" configuration thereby significantly enhancing the efficiency of the fin portions in terms of its drivingly engaging the flow of water alternatively passing over the aforementioned opposite surfaces, as the swimmer demonstrates the aforementioned dolphin kick in the intended manner.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying Figures, the present invention is directed to a swim fin generally indicated as 10, and preferably configured to be removably securable to one foot of a swimmer. In conventional fashion, the swim fin 10 is preferably intended to be used in pairs, such that each of two of the swim fins 10 are removably secured to different feet of the swimmer. For purposes of clarity, both the structural and operative features of each swim fin 10, of a pair of such swim fins, will be described with relation to a single swim fin, as demonstrated in FIG. 1, wherein the dimension, configuration and structural features of each swim fin, of the preferred pair of swim fins, may substantially correspond to one another.

Figure 1:
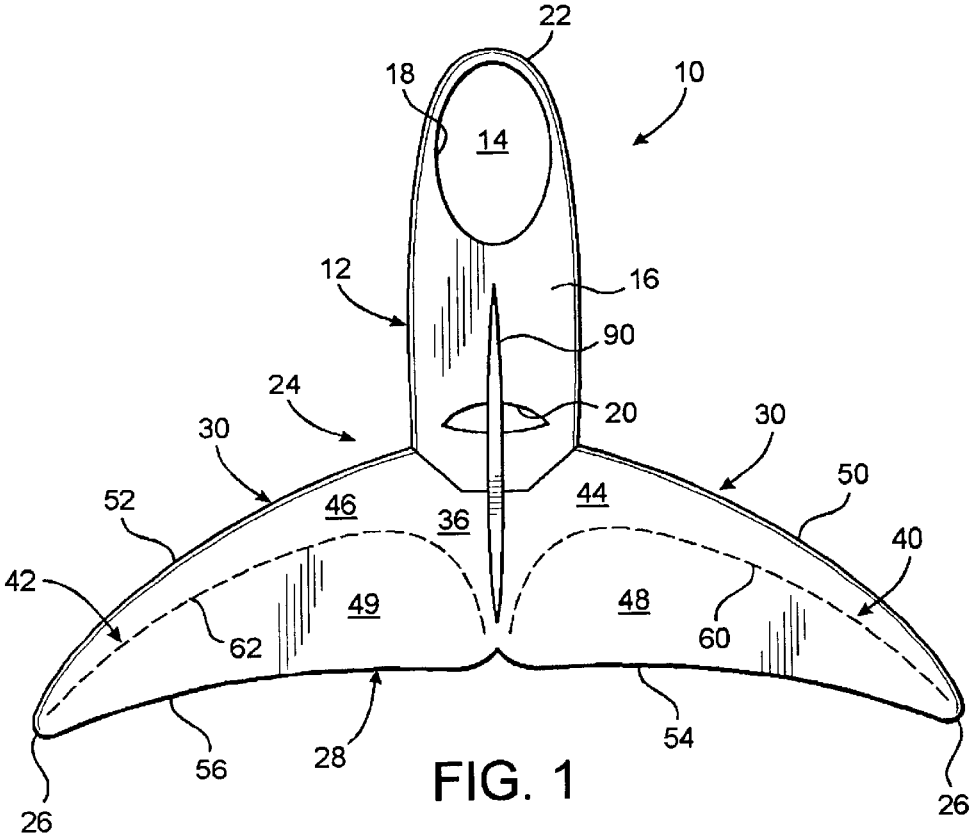
FIG. 1 is a top view of one of a pair of swim fins of the present invention.

More specifically, the swim fin 10 includes an attachment portion, generally indicated as 12, and structured to be removably mounted on one foot of a swimmer. The attachment portion 12 preferably comprises a substantially hollow interior, as at 14, dimensioned and configured to receive and surround at least a portion of the user's foot. The body 16 of the attachment portion 12 may also be formed into a shoe-like foot pocket, which substantially encases almost the entire foot of a swimmer, such that the swimmer passes his foot through an opening 18 into the hollow interior 14 of the foot pocket. As shown in the embodiment of FIG. 1, an opening or aperture 20 may also be formed in the body 16 so as to increase the comfort of the swimmers foot, as well as providing an access for the entrance of water into the interior 14 of the foot pocket. It is to be noted, however, that the body 16 may have a variety of alternative structural configurations including the interior 14 being shaped to only engage the frontal portion of the foot and include an at least partially detachable or moveable retaining strap located as at 22 and being disposed in overlying relation to the heel of the swimmer's foot, the primary objective being to secure the attachment portion 12 operatively on the wearer's foot for the normal use of the swim fin 10.

Figure 4:
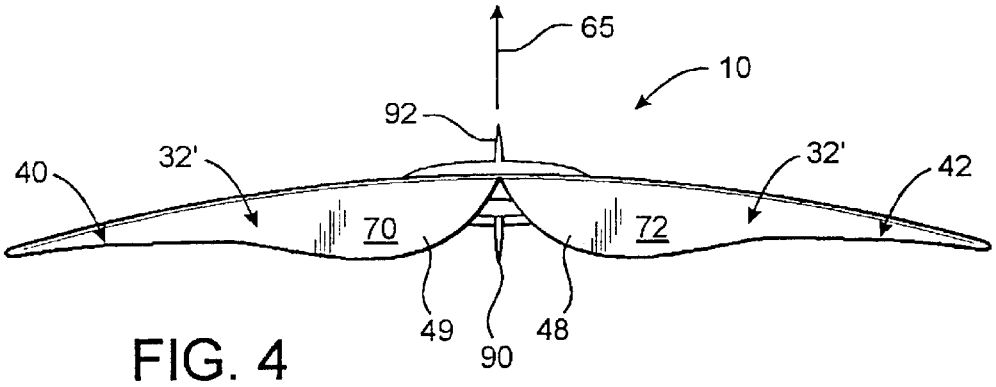
FIG. 4 is a rear view of the swim fin of the embodiment FIG. 1 while passing through an up stroke.
Figure 5:
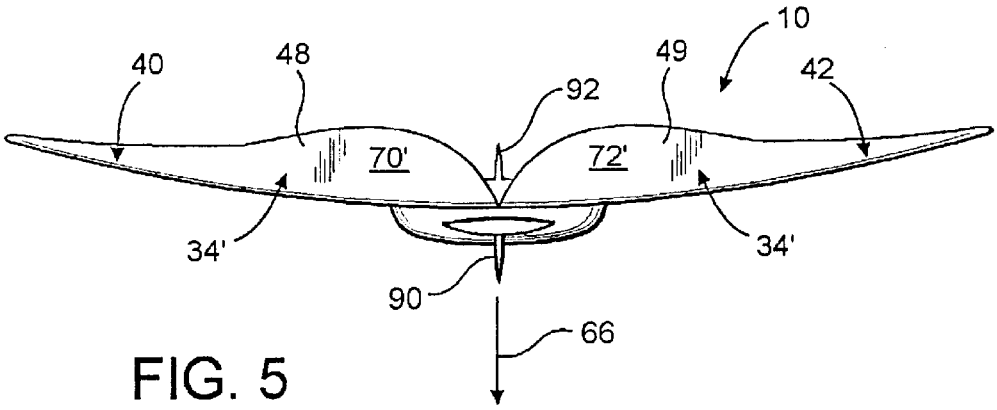
FIG. 5 is a rear view similar to that of FIG. 4, wherein the swim fin of the present invention is passing through a down stroke.
Figure 6:
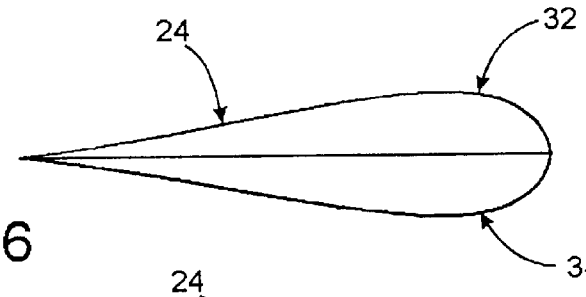
FIG. 6 is a transverse sectional view of a fin portion of the swim fin of the embodiment of FIG. 1, when in a neutral position.
Figure 7:
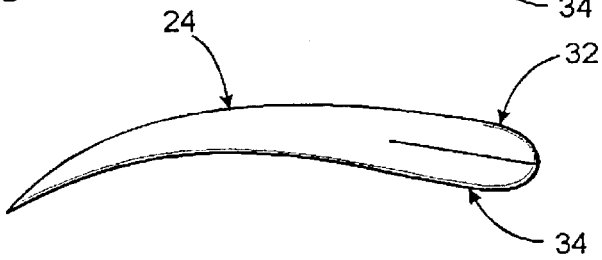
FIG. 7 is a transverse sectional view of the fin portion of the embodiment of FIG. 1 while passing through an up stroke.
Figure 8:
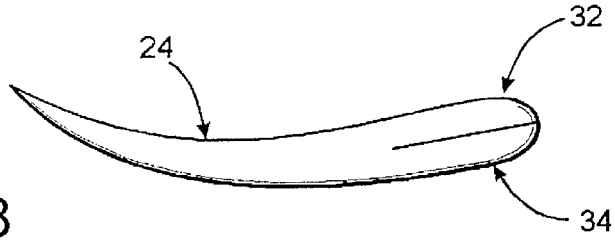
FIG. 8 is a transverse sectional view of the fin portion of the embodiment of FIG. 1 while passing through a down stroke.

The swim fin 10 also includes a fin portion, generally indicated as 24. The fin portion 24 preferably comprises a somewhat elongated triangular configuration. The configuration and orientation of the fin portion 24 is such that a primary longitudinal dimension thereof, such as the distance between the outer ends or tips 26 of the fin portion 24, is oriented in a substantially transverse relation to the length of the attachment portion 10. In particular, the aforementioned generally triangular configuration, as well as the transverse orientation of the fin portion 24, is more specifically defined by a railing edge 28 and a leading edge 30 of the fin portion 24 being spaced from one another along at least a majority of the length of the trailing edge 28. As such, both the trailing and leading edges 28 and 30, are preferably oriented in substantially transverse relation to the attachment portion 12, such that the fin portion 24 extends laterally outward from the attachment portion 12 in a manner clearly demonstrated in FIGS. 1, 4 and 5. For purposes of clarity only, the terms "leading" and "trailing" are intended to describe the designated edges 30 and 28 respectively, when the swim fin 10 of the present invention is mounted on a foot of the swimmer in an orientation which facilitates the forward, head first travel of the swimmer along an intended path. In such an orientation, the leading edge 30 of the fin portion 24 would first come into contact with the flow of water passing over the fin portion 24 and the trailing edge 28 would be operatively disposed behind the leading edge 30. Also in this orientation the flow of water would be drivingly engaged, alternately, by the opposite surfaces 32 and 34, as shown in FIG. 6 through 8 and as will be explained in greater detail hereinafter.

More specifically, the fin portion 24 preferably comprises two flukes 40 and 42 integrally or otherwise secured to one another. Furthermore, in a substantially symmetrical embodiment of the present invention, as depicted in the figures, the flukes may extend oppositely from an imaginary center line, which preferably, but not necessarily is disposed in co-extensive relation to a central longitudinal axis of the attachment portion 12. Each of the flukes 40 and 42 are preferably equivalently and/or correspondingly dimensioned and configured, such that the two flukes 40 and 42 collectively define a different half of the aforementioned elongated triangular configuration of the fin portion 24.

Additionally, each of the flukes 40 and 42 preferably includes a core segment 44 and 46, collectively defining a core of the fin portion 24, and a trailing segment 48 and 49 respectively. Preferably, each of the core segments 44 and 46 of the respective flukes 40 and 42 extends from a corresponding leading edge segment 50 and 52, towards the trailing edge 28. Along these lines, the leading edge segments 50 and 52 collectively define the aforementioned leading edge 30 of the fin portion 24, while trailing edge segments 54 and 56, collectively define the trailing edge 28 of the fin portion 24.

Looking to FIG. 1, a separation or demarcation between the core segments 44,46 and the respective trailing segments 48,49 of each fluke 40 and 42 is represented by an imaginary 16 line depicted in phantom and indicated as 60 and 62, respectively. The representation of the demarcation lines 60 and 62 is provided to emphasize the different structural and operative features of the core segments 44 and 46 from the respective trailing segments 48 and 49. More specifically, each of the core segments 44 and 46, and accordingly the core of the fin portion 34, are preferably formed from a semi-flexible or at least partially flexible material having a somewhat limited amount of flexibility. As such, the core segments 44, 46 operatively result in a "whiplike" motion, as the fin portion 24, as well as the remainder of the swim fin 10, pass in opposite directions through both the up and down strokes of the dolphin kick utilized by a swimmer. In the illustrated embodiment, the material from which each of the core segments 44 and 46 is formed may include a semi-flexible plastic, or in certain preferred embodiments may be a carbon fiber material used in combination with a rubber or plastic material, so as to provide the aforementioned whiplike action. In particular, the referred to whiplike action is especially prevalent as the fin portion 24, as the entire swim fin 10, changes direction when passing through the transition between the upward and downward strokes, as indicated respectively by directional arrows 65 and 66 in FIGS. 4 and 5.

The trailing segment 48 and 49 of each fluke 40 and 42 is preferably formed from a material having significantly greater flexibility than the respective core segments 44 and 46. More specifically, each of the trailing segments 48 and 49 has sufficient flexibility to assume what may be considered a "variable" configuration to the extent that the configuration of each of the trailing segments 48 and 49 may freely change or "automatically" self-adjust to assume a configuration which at least partially depends on, and is in substantial conformance with, a flow of water passing over at least one of the two, oppositely disposed, surfaces 32 and 34. The variable configuration of the trailing segment 48 and 49 of each fluke 40 and 42 is dependent at least in part on whether the swim fin is passing through an up stroke, as demonstrated in FIG. 4, or a down stroke, as demonstrated in FIG. 5. The aforementioned variable configuration is also at least partially defined by a temporarily formed pocket defined in portions of each exposed surface 32 and 34 associated with each of the flukes 40 and 42. In particular, when the swim fin 10 is passing through an upwardly directed stroke, as indicated by directional arrow 65, each of the flukes 40 and 42 will have a pocket 70 and 72 formed in the exposed surface 32' associated therewith. Each of the pockets 70 and 72 preferably includes an arcuate or somewhat concave configuration, and is disposed and shaped intermediate the opposite ends of the flukes, and preferably somewhat adjacent to the aforementioned inner end or imaginary center line, which defines the preferably seamless integral connection between the flukes. Further, each of the pockets 70 and 72 are dimensioned and configured to at least minimally or partially surround a flow of water passing over the surface segments 32' in a manner which facilitates driving engagement with the flow of water, causing a propelling force, which aids in the forward travel of the swimmer, to be exerted on the swim fin 10. Similarly, and as shown in FIG. 5, as the swim fin 10 passes into and along a downward stroke, as indicated by directional arrow 66, the temporarily formed pockets 70' and 72' are defined oppositely in each fluke 40 and 42. Accordingly, in the down stroke, each fluke 40 and 42 assumes a variable configuration defined at least in part by an arcuate or concave configuration, which at least minimally or partially surrounds the flow of water passing over or along surface segments 34' associated with each of the trailing segments.

Figure 2:
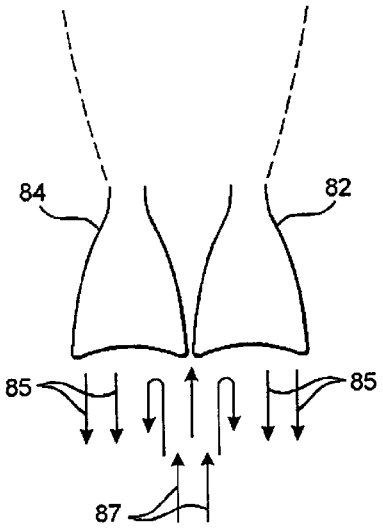
FIG. 2 (PRIOR ART)
FIG. 2 is a schematic representation of prior art swim fin structures.
Figure 3:
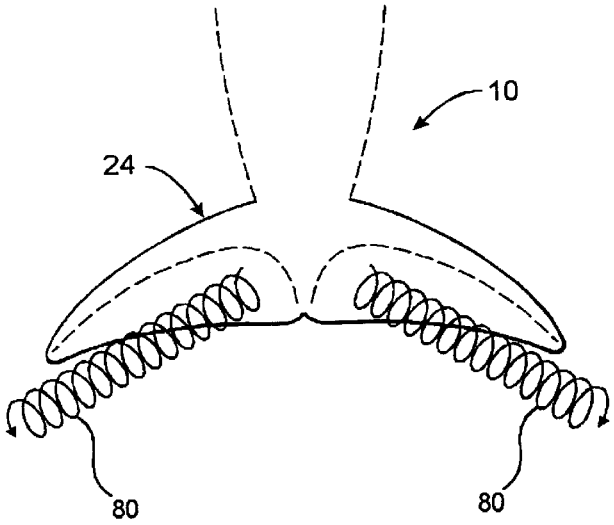
FIG. 3 is a schematic view showing the flow of water using the swim fin of the present invention.

By virtue of the structural features described with reference to the Figures, the swim fin 10 demonstrates somewhat of a gliding motion, as the fin portion 24 passes through both the up stroke and down stroke 66. This gliding motion helps streamline the normally disturbed trailing water or wake passing behind the swimmer, thereby reducing drag on the swimmer. Moreover, portions of the flow of water passing over the respective surfaces of the swim fin portion 24 are directed laterally outward in a helical or spinning path of travel, as indicated schematically as 80, in FIG. 3. Indeed, this helical or spinning action of the flow of water passing over the fin portion 24 of each fin structures 10 differs greatly from that demonstrated in the prior art fin structures of FIG. 2, wherein each of the conventional fin structures 82 and 84 alternately passes through up and down strokes of a scissor or flutter kick. In the prior art structure, the fins 82 and 84 direct the normally disturbed flow of water outwardly, as indicated by directional arrows 85, while, at least to a certain extent, drawing the flow of water back inwardly during a "reload" portion of the kick normally associated with the upwardly directed stroke.

With reference to FIGS. 6 through 8, another structural feature of the present invention comprises at least a portion, or most preferably a majority of the fin portion, having a hydrodynamic foil defined by the oppositely disposed, somewhat convex surface configurations of the exposed surfaces 32 and 34, collectively oriented into a somewhat elongated "teardrop" configuration, as best shown in the transverse sectional view of the neutral position of FIG. 6. During the upward stroke of FIG. 7, the transverse sectional view, is demonstrated by the orientation of the fin portion 24 in the position shown. Similarly, during the downward stroke, the elongated teardrop configuration is modified to the extent shown in FIG. 8. The presence of the configuration of the hydrodynamic foil depicted in FIGS. 6, 7 and 8, greatly increases the efficiency, especially during the double motion of the fin portion 24, when the swimmer utilizes the aforementioned dolphin kick. As shown in FIGS. 5 and 6 both the upward stroke 65 and downward stroke 66 results in a propelling and/or driving engagement with the flow of water passing respectively over the surface segment 32' and 34', associated with each of the flukes 40 and 42.

Other structural features of certain embodiments of the present invention may include the provision of an elongated upwardly extending and at least partially rigid keel member 90 formed on an outer portion of the body 16. For example, the keel member 90 may be formed on the upper portion of the body 16 of the attachment portion 12 and extend longitudinally therefrom into overlying fixed engagement with the surface 32 of the fin portion 24. In addition to the keel member 90 or as an alternative structure therefor, a similar but normally somewhat smaller keel member 92 may be formed on the undersurface of the attachment portion 12 and or fin portion 24, as shown in FIGS. 4 and 5.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A swim fin structured to be removably secured to a swimmer's foot, said swim fin comprising:

a) an attachment portion structured to be removably mounted on the foot, b) a fin portion secured to said attachment portion and including a core portion and a trailing portion, c) said core portion extending from a leading edge towards and in at least partially spaced relation to a trailing edge, d) said trailing portion extending from said core portion towards and in contiguous relation to said trailing edge, and e) said trailing portion further formed from a material having sufficient flexibility to assume a variable configuration corresponding to and in substantial conformance with a flow of water passing along said trailing portion.

2. A swim fin as recited in claim 1 wherein said fin portion comprises a trailing edge, said trailing edge disposed in spaced relation to said leading edge along at least a majority of a length of said trailing edge.

3. A swim fin as recited in claim 2 wherein said leading edge extends laterally outward from opposite sides of said attachment portion.

4. A swim fin as recited in claim 3 wherein said leading edge comprises a plurality of leading edge segments, each of said leading edge segments extending laterally outward from a different side of said attachment portion.

5. A swim fin as recited in claim 1 wherein said leading edge is oriented in substantially transverse relation to a length of said attachment portion and extends laterally outward from said attachment portion.

6. A swim fin as recited in claim 5 wherein said leading edge comprises leading edge segments, each of said leading edge segments extending laterally outward from a different, substantially oppositely disposed side of said attachment portion.

7. A swim fin as recited in claim 5 wherein said fin portion further comprises a trailing edge transversely oriented relative to said attachment portion and extending along substantially the entire length of said fin portion.

8. A swim fin as recited in claim 1 wherein said core is formed of a material having significantly less flexibility than said trailing portion.

9. A swim fin as recited in claim 1 wherein said variable configuration is at least partially defined by at least one pocket temporarily formed in said trailing portion.

10. A swim fin as recited in claim 9 wherein said one pocket assumes a substantially opposite orientation dependent on the swim fin passing through an up-stroke or a downstroke.

11. A swim fin as recited in claim 10 wherein said one pocket is alternatively formed in opposite exposed surfaces of said trailing portion.

12. A swim fin as recited in claim 10 wherein said one pocket assumes an at least partially concave configuration in each of said opposite orientations.

13. A swim fin structured to be removably secured to a swimmer's foot, said swim fin comprising:

a) an attachment portion structured to be removably mounted on the foot, b) a fin portion secured to said attachment portion and including a leading edge and a trailing edge, c) said fin portion including two flukes correspondingly dimensioned and configured and substantially defining a different half of said fin portion, d) each of said flukes further including a core segment and a trailing segment, e) each of said core segments extending from said leading edge towards and in at least partially spaced relation to said trailing edge, f) each of said trailing segments extending from said core segment towards and in contiguous relation to said trailing edge, and g) each of said trailing segments formed from a material having sufficient flexibility to assume a variable configuration corresponding to and in substantial conformance with a flow of water passing along said trailing segments.

14. A swim fin as recited in claim 13 wherein said fin portion comprises a substantially triangular configuration collectively defined by said two flukes.

15. A swim fin as recited in claim 14 wherein said two flukes are correspondingly dimensioned and configured, each of said two flukes substantially defining a different half of said triangular configuration of said fin portion.

16. A swim fin as recited in claim 15 wherein each of said two flukes extends laterally outward from an opposite side of said attachment portion.

17. A swim fin as recited in claim 13 wherein said leading edge is defined by two leading edge segments each formed on a different one of said two flukes.

18. A swim fin as recited in claim 13 wherein said variable configuration is at least partially defined by at least one pocket selectively formed in each of said two flukes, each of said pockets shaped to at least minimally surround the flow of water and disposed in propelling relation thereto.

19. A swim fin as recited in claim 18 wherein each of said pockets assumes an at least partially concave configuration, said concave configuration further defining at least a portion of said variable configuration.

20. A swim fin as recited in claim 19 wherein each of said pockets is disposed substantially intermediate opposite ends of respective ones of said flukes.

21. A swim fin as recited in claim 18 wherein each of said pockets assumes an at least partially concave configuration, said concave configuration further defining at least a portion of said variable configuration.

22. A swim fin as recited in claim 18 wherein each of said pockets is disposed substantially adjacent correspondingly positioned inner ends of respective ones of said flukes.

23. A swim fin as recited in claim 18 wherein each of said pockets assumes a substantially opposite orientation dependent on the swim fin passing through an up-stroke or a downatroke.

24. A swim fin as recited in claim 23 wherein each of said pockets is alternatively formed in opposite exposed surfaces of a corresponding one of said flukes.

25. A swim fin as recited in claim 13 wherein each of said flukes comprises a substantially elongated teardrop shaped transverse cross-sectional configuration at least partially defined by respective core segments thereof, each of said core segments including opposite exposed surfaces having a substantially convex configuration.

* * * * *